US008622268B2

(12) United States Patent
Townsend et al.

(10) Patent No.: US 8,622,268 B2
(45) **Date of Patent: *Jan. 7, 2014**

(54) STRUCTURAL SUPPORT MEMBER FOR A HARNESS FOR BREATHING APPARATUS

(75) Inventors: Paul Townsend, Northumberland (GB); Gordon Wrigley, Tyne and Wear (GB)

(73) Assignee: Draeger Safety UK Limited, Blyth (Northumberland) (GB)

( * ) Notice: Subject to any disclaimer, the term of this patent is extended or adjusted under 35 U.S.C. 154(b) by 134 days.

This patent is subject to a terminal disclaimer.

(21) Appl. No.: 12/774,107

(22) Filed: May 5, 2010

(65) Prior Publication Data

US 2010/0282791 A1 Nov. 11, 2010

(30) Foreign Application Priority Data

May 6, 2009 (GB) ..... 0907748.8

(51) Int. Cl.
*A45F 3/10* (2006.01)
*B63C 11/22* (2006.01)

(52) U.S. Cl.
USPC ..... 224/576; 224/633; 128/205.22; 405/186

(58) Field of Classification Search
USPC ..... 224/628, 633, 635, 637, 645, 148.1, 224/576; 128/205.22; 405/185
See application file for complete search history.

(56) References Cited

U.S. PATENT DOCUMENTS

| | | | | |
|---|---|---|---|---|
| 2,675,150 | A * | 4/1954 | Ackerman | 224/635 |
| 4,049,164 | A | 9/1977 | Sullivan et al. | |
| D391,368 | S * | 2/1998 | Hall | D24/110 |
| 6,857,820 | B2 * | 2/2005 | Jacoway et al. | 405/186 |
| 7,198,186 | B2 * | 4/2007 | Kling et al. | 224/628 |
| 7,748,380 | B1 * | 7/2010 | Phifer et al. | 128/201.25 |
| 7,758,004 | B2 * | 7/2010 | Brookman et al. | 248/311.3 |
| 7,793,809 | B2 * | 9/2010 | Howell | 224/628 |
| 8,006,877 | B2 * | 8/2011 | Lowry et al. | 224/633 |
| D653,324 | S * | 1/2012 | Townsend et al. | D24/110 |
| D653,325 | S * | 1/2012 | Cheesman et al. | D24/110 |
| 2003/0127483 | A1 * | 7/2003 | Black | 224/628 |
| 2010/0282252 | A1 * | 11/2010 | Cheesman et al. | 128/202.19 |

FOREIGN PATENT DOCUMENTS

| | | | | |
|---|---|---|---|---|
| EP | 0 903 162 | A2 | 3/1999 | A62B 9/04 |
| FR | 2737125 | A1 | 1/1997 | |
| WO | 2007056828 | A1 | 5/2007 | |

OTHER PUBLICATIONS

Search report under Section 17 for GB0907748.8, date of search Aug. 19, 2009, 1 p.

* cited by examiner

*Primary Examiner* — Justin Larson
(74) *Attorney, Agent, or Firm* — DLA Piper LLP (US)

(57) ABSTRACT

A structural support member 10 for a harness 100 for breathing apparatus, the structural support member being generally elongate and arranged in use to support a cylinder of breathable gas, the structural support member comprising: a frame having; a lower portion 11 arranged in use to support a first end of a cylinder; an upper portion arranged in use to support a second opposed end of the cylinder; and first and second side limbs 26, 36 coupling the upper and lower portions and defining a void 14 therebetween, in a substantially central region of the frame.

18 Claims, 11 Drawing Sheets

STRUCTURAL SUPPORT MEMBER FOR A HARNESS FOR BREATHING APPARATUS

This application is a utility application which claims the priority of United Kingdom Patent Application No. GB 0907748.8, filed May 6, 2009 incorporated herein by reference in its entirety.

BACKGROUND OF THE INVENTION

The present invention relates to a structural support member for a harness for breathing apparatus, in particular, a structural support member comprising a frame.

Self-contained breathing apparatus (SCBA) harnesses comprise a structural support member for supporting a cylinder of breathable gas and a pair of shoulder straps and a belt to facilitate the carrying of the structural support member of the back of a user. The structural support member is provided with a valve towards its lower end and a retaining strap at its upper end. In use, a cylinder of breathable gas is attached to the valve and is further secured to the structural support member by means of the retaining strap which is made to pass around an upper portion of the cylinder. A number of flexible hoses extended from the valve to the shoulder straps so that breathing apparatus worn by the user may be conveniently connected thereto.

It is known to use a back plate as the structural support member. This is usually in the form of a generally flat elongate plate. When a user wears the harness the back plate rests against and along his back. The shoulder and waist straps are tightened on the user such that the back plate is held close to the user. When a user bends over, the back plate does not bend with the user because the back plate is rigid. This causes the user's back, and particularly his spine, to be pressed tightly against the back plate which can be uncomfortable.

It is therefore desirable to provide a more comfortable structural support member for a harness for breathing apparatus.

SUMMARY OF THE INVENTION

According to a first aspect of the present invention there is provided a structural support member for a harness for breathing apparatus, the structural support member being generally elongate and arranged in use to support a cylinder of breathable gas, the structural support member comprising: a frame having: a lower portion arranged in use to support a first end of a cylinder; an upper portion arranged in use to support a second opposed end of the cylinder; and first and second side limbs coupling the upper and lower portions and defining a void therebetween, in a substantially central region of the frame.

The void may be substantially longitudinally coextensive with the gas-cylinder that is to be mounted on the back frame. The void may be substantially transversely coextensive with the gas-cylinder that is to be mounted on the back frame.

Preferably the void is arranged such that in use it can accommodate a portion of a wearer's back/spine when the wearer bends his back/spine.

Preferably the void is delimited by the upper portion, the lower portion and the first and second limbs. The first and second side limbs may be disposed either side of the gas-cylinder that is to be mounted to the back frame.

At least one of the side limbs may have a guide channel for accommodating a flexible conduit.

The upper portion may comprise a yoke that is detachably attached to the back frame. Preferably the yoke is detachably attached to the first and second side limbs.

In one embodiment the structural support member is further arranged in use to support one or more components that are operatively associated with the breathing apparatus, and the structural support member comprises first and second parts attached along a longitudinal extent of the structural support member and defining therebetween a housing for retaining one or more of the components.

The longitudinal extent along which the first and second parts are attached may be substantially coincident with a longitudinal centreline of the structural support member.

The first and second parts may define a housing within the lower portion of the structural support member, arranged in use to retain a valve for the cylinder. The first part may comprise the first side limb and the second part may comprise the second side limb.

The longitudinal extent along which the first and second parts are attached may be substantially coincident with a longitudinal centreline of the lower portion.

According to another aspect of the present invention there is provided a harness for breathing apparatus comprising a structural support member according to any statement herein.

The invention may comprise any combination of the features and/or limitations referred to herein, except combinations of such features as are mutually exclusive.

BRIEF DESCRIPTION OF THE DRAWINGS

Embodiments of the present invention will now be described, by way of example only, with reference to the accompanying drawings, in which.

DESCRIPTION OF EMBODIMENTS OF THE INVENTION

Figure 1:
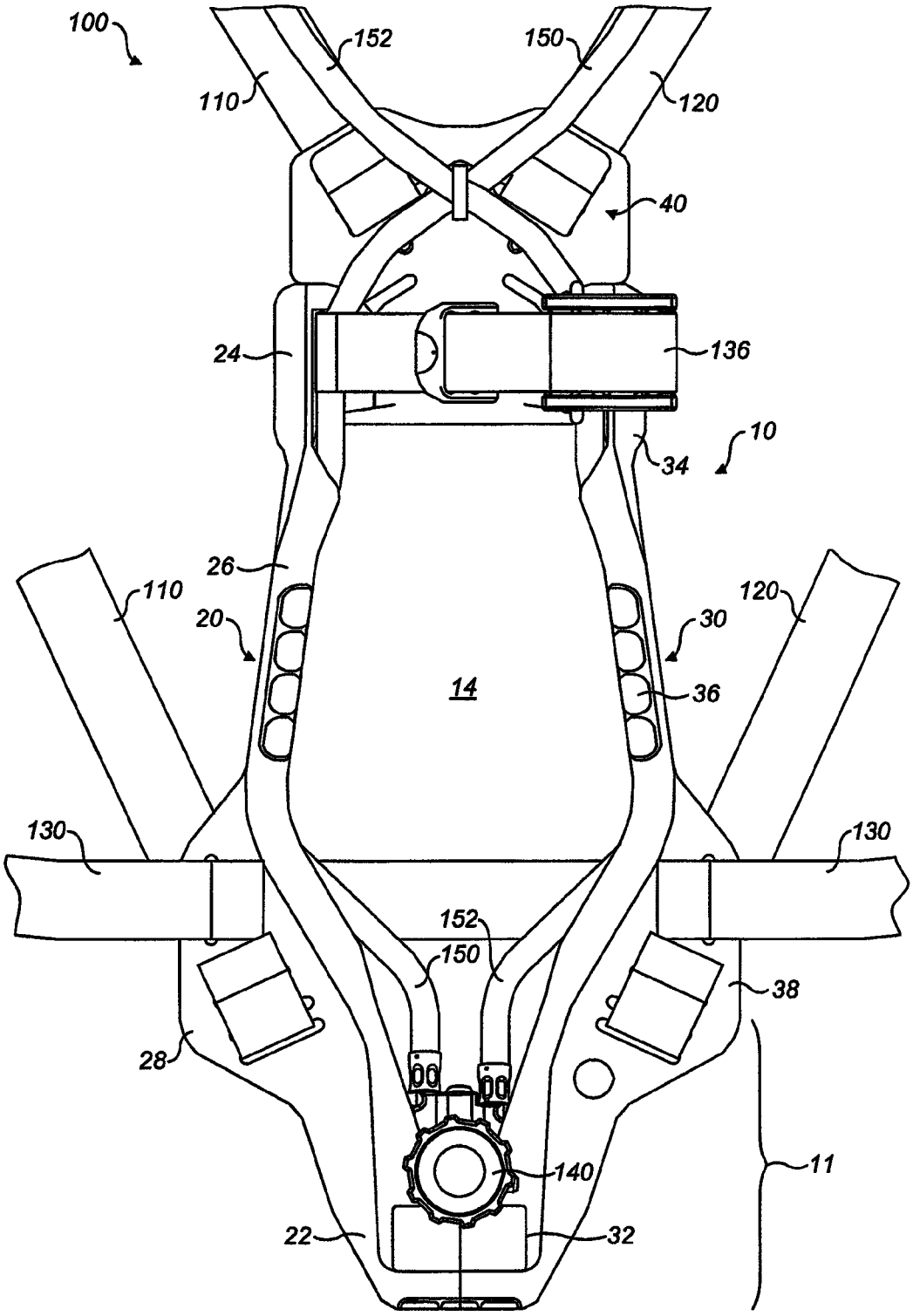
FIG. 1 schematically shows a harness for breathing apparatus comprising a back frame according to an embodiment of the present invention.

Turing to FIG. 1, this shows a harness 100 for breathing apparatus comprising a structural support member in the form of a back frame 10. The harness 100 comprises left and right shoulder straps 110, 120, a waist belt 130 and a gas-cylinder retaining strap 136. A gas-cylinder reducer valve 140 is mounted within a lower portion 11 of the back frame 10. A high-pressure hose 150 and medium-pressure hose 152 extend from the reducer valve 140, along the back frame 10 to positions on the left and right shoulder straps 110, 120.

Figure 2:
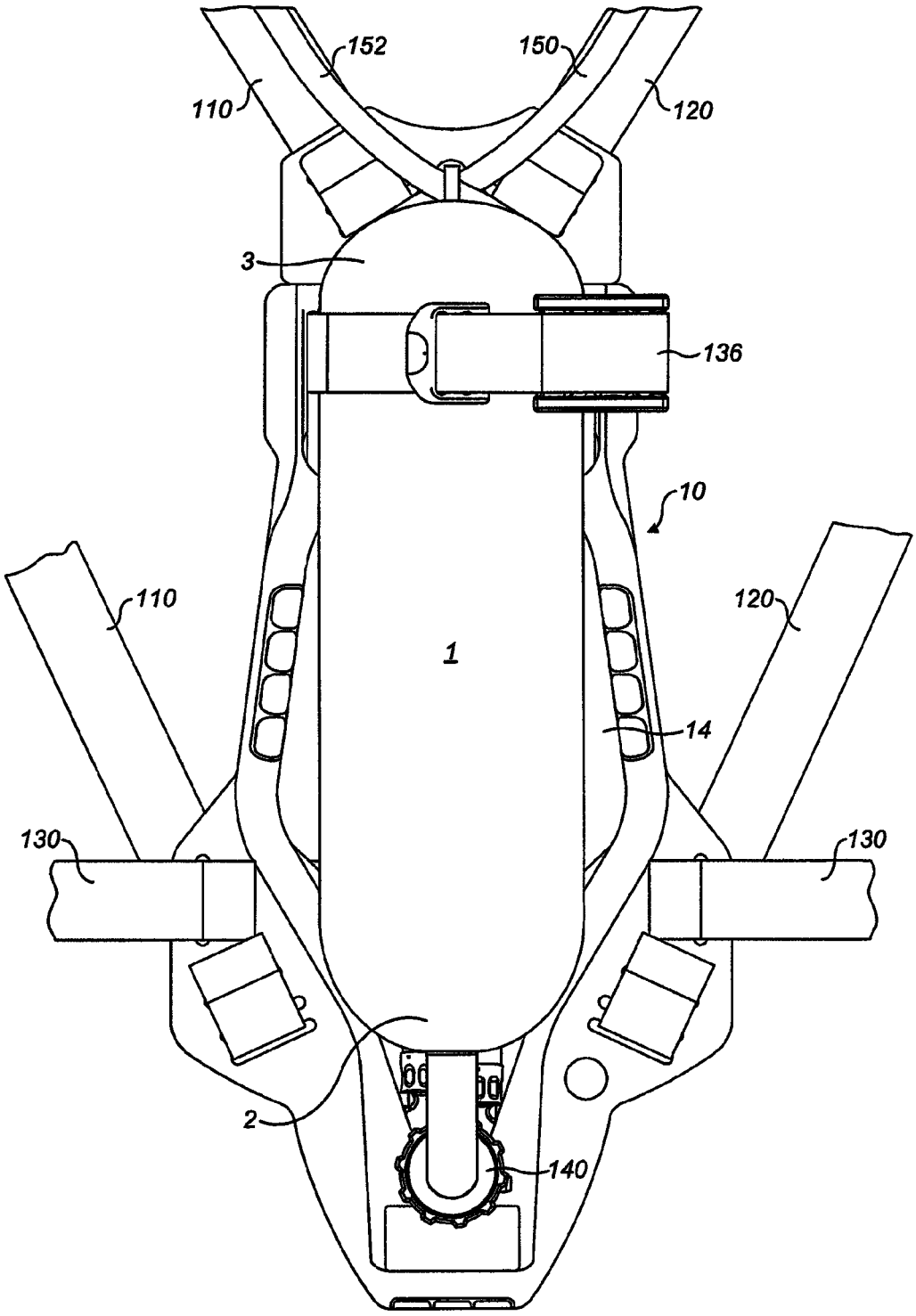
FIG. 2 schematically shows the harness of FIG. 1 with a gas-cylinder mounted on the back frame.

As shown in FIG. 2, in use a gas-cylinder 1 is mounted to the back frame 10 of the harness 100. A first end 2 of the gas-cylinder is supported by a lower portion 11 of the back frame 10 and a second end 3 of the gas-cylinder is supported by an upper portion of the back frame 10. The first end 2 of the gas-cylinder is attached to the reducer valve 140 that is mounted within a lower portion of the back frame 10 and the second end 3 is strapped to the upper portion of the back frame using the retaining strap 136.

Figure 3:
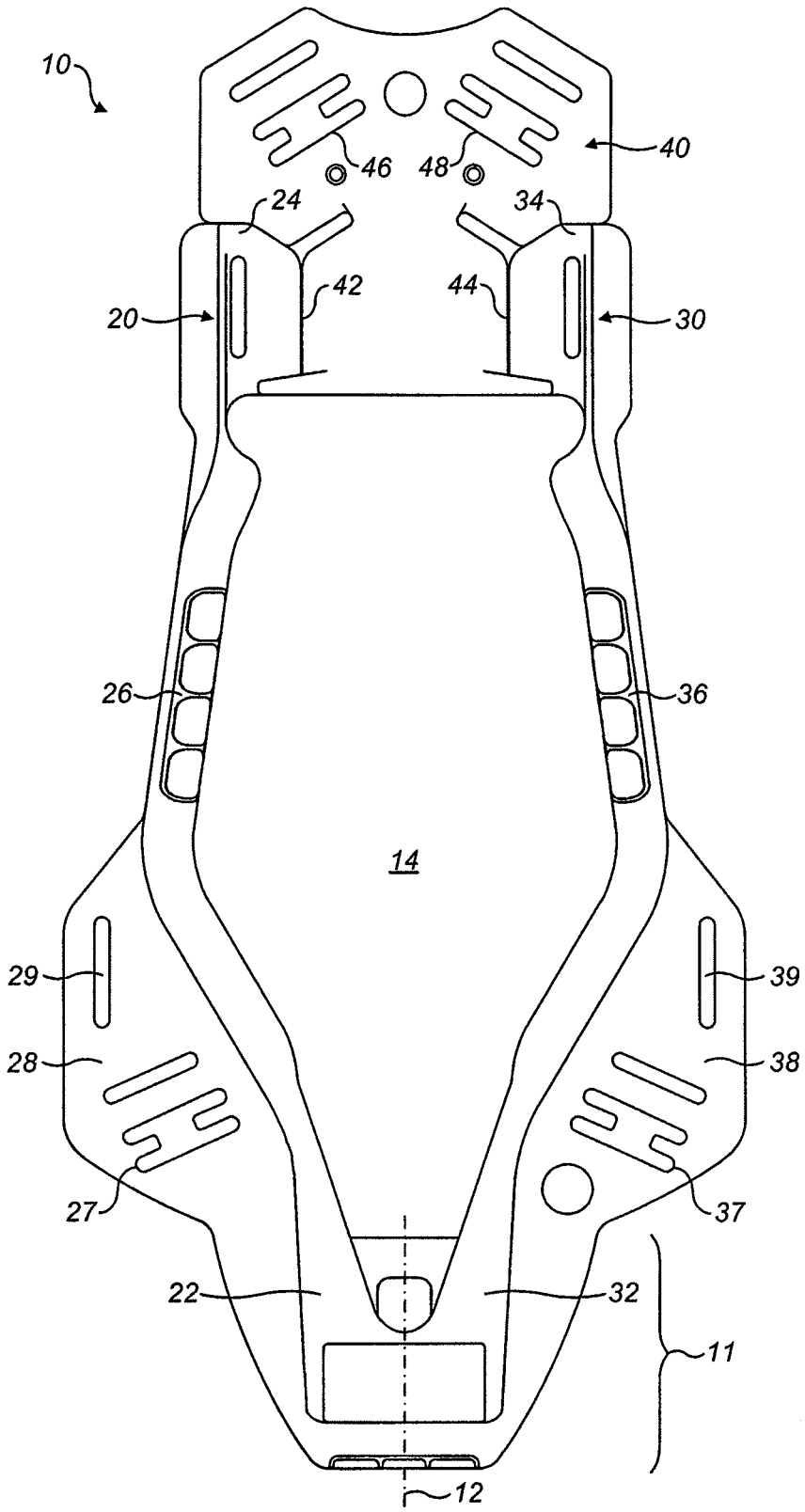
FIG. 3 schematically shows a front view of the back frame shown in FIG. 1.

FIG. 3 shows a front view of the back frame 10 alone. The back frame 10 comprises a first part 20 a second part 30 and a yoke 40. The first and second parts 20, 30 are substantially the same but are mirror images of one another. They are connected together towards the lower portion of the back frame along a longitudinal axis 12 of the back frame 10 which is coincident with the centre line of the back frame 10. The first and second parts 20, 30 are connected together towards the upper portion of the back frame 10 by the yoke 40.

The first part 20 comprises a first lower portion 22 and a first upper portion 24 that make up the lower portion 11 of the back frame 10. A first side limb 26 extends longitudinally and connects the first lower portion 22 to the first upper portion 24. The first part 20 further comprises a first side flange 28 which comprises two fixing portions 27, 29 to which the left shoulder strap 110 and the waist strap 130 can be attached.

The second part 30 comprises a second lower portion 32 and a second upper portion 34. A second side limb 36 extends longitudinally and connects the second lower portion 32 to the second upper portion 34. The second part 30 further comprises a second side flange 38 which comprises two fixing portions 37, 39 to which the right shoulder strap 120 and the waist strap 130 can be attached.

The first and second side limbs 26, 36 define a void 14 in a central region of the back frame 10. The void 14 is delimited by the first and second side limbs 26, 26, the lower portion 11 of the back frame 10 and the yoke 40 (or upper portion of the back frame 10). The void 14 extends longitudinally along, and transversely across, the majority, or at least a substantial portion, of the back frame 10.

Figure 4:
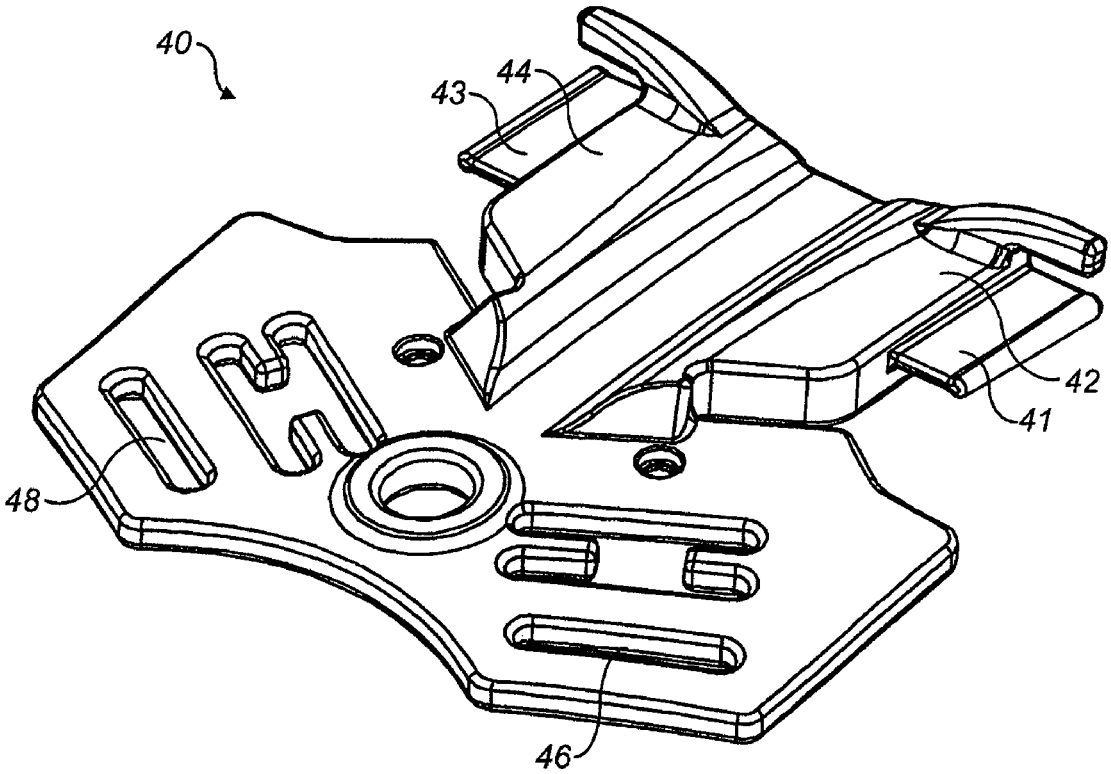
FIG. 4 schematically shows a yoke portion of the back frame of FIG. 3.

With reference to FIG. 4, the yoke 40 of the back frame 10 comprises first and second attachment portions 42, 44 for attaching the yoke 40 to the first and second parts 20, 30 respectively. The first and second attachment portions 42, 44 each comprise a tongue 41, 43 (described in more detail below). The yoke 40 further includes left and right shoulder strap fixing portions 46, 48 to which the left and right shoulder straps 110, 120 can be attached.

Figure 5:
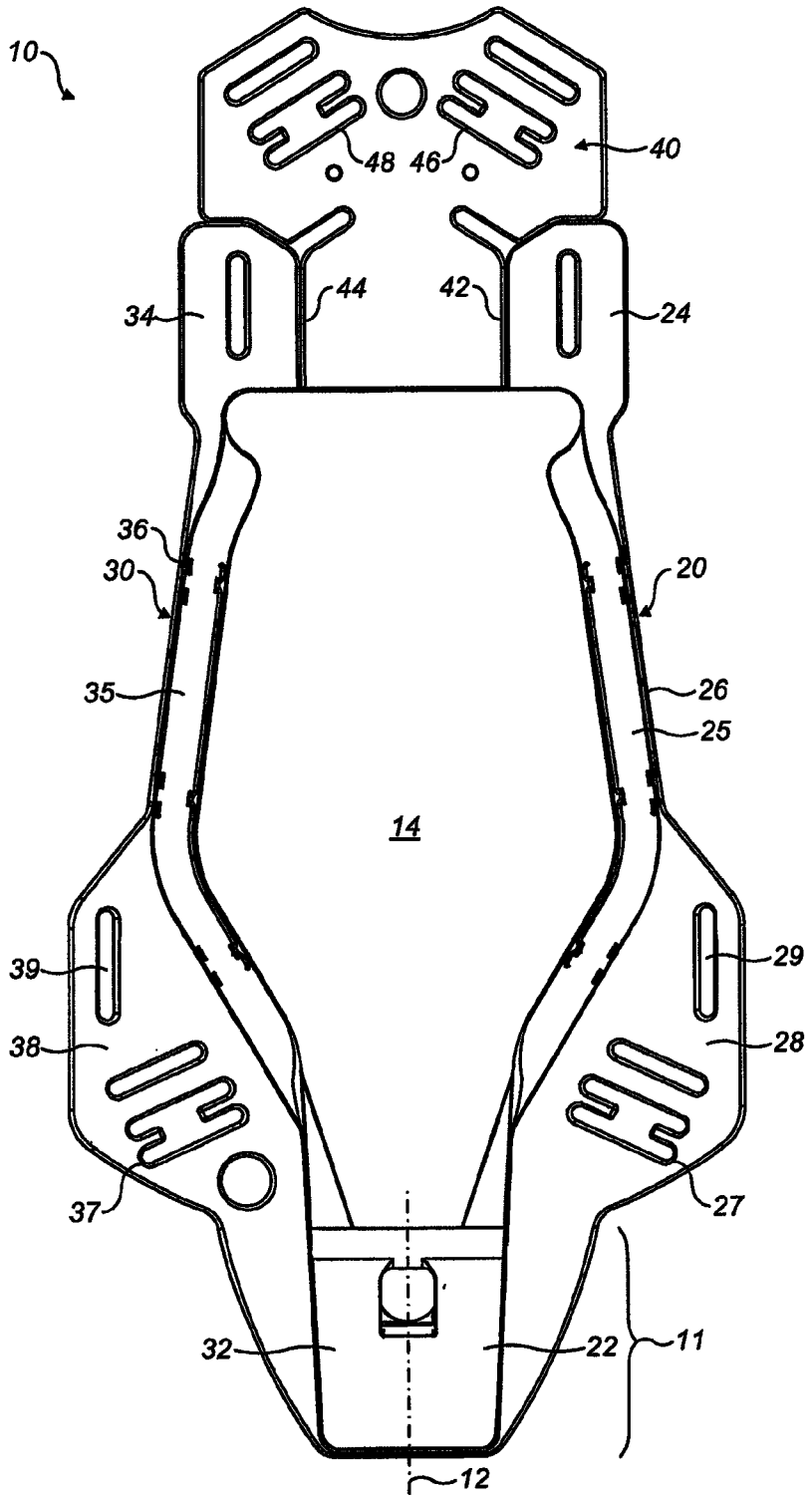
FIG. 5 schematically shows a rear view of the back frame shown in FIG. 3.

FIG. 5 shows a rear view of the back plate 10 alone. The first side limb 26 comprises a first guide channel 25 and the second side limb 36 comprises a second guide channel 35. These channels 25, 35 are arranged to accommodate and retain the high-pressure hose 150 and the medium pressure hose 152 respectively. The guide channels 25, 35 are shaped with projections within and along their length that are arranged to retain flexible conduits within the channels. However, as will be readily apparent to one skilled in the art, other means for retaining flexible conduits within the channels are possible.

Figure 6:
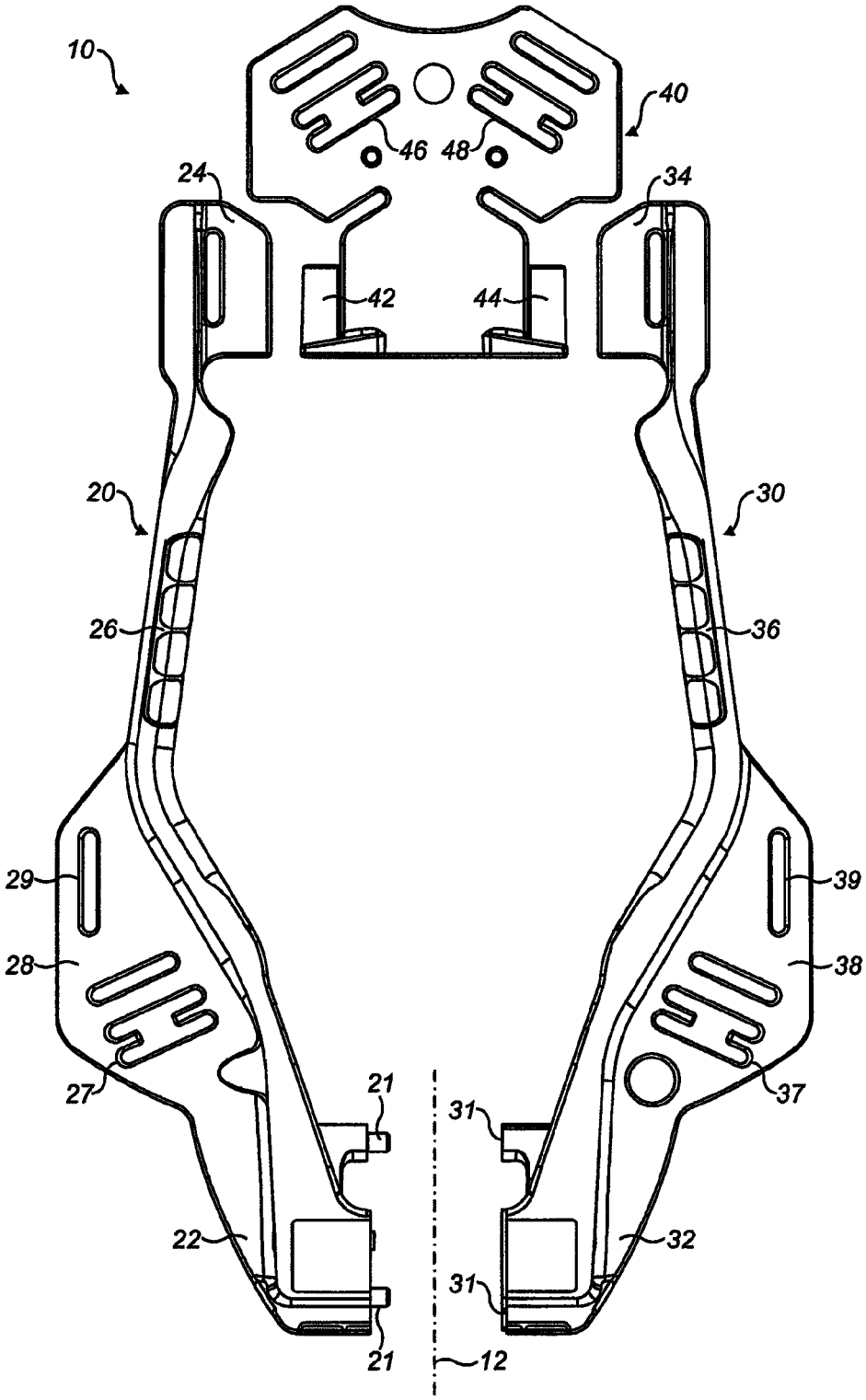
FIG. 6 schematically shows the back frame of FIG. 3 in a disassembled state.

FIG. 6 shows the back frame 10 in a disassembled state. As can be seen, the first part 20, second part 30 and yoke 40 are completely separable. The first and second parts 20, 30 are attached along a longitudinal axis 12 of the back frame 10. The first part 20 comprises two protrusions 21 that, upon assembly, are inserted into two holes in the second part 31 (not shown). A nut and bolt (not shown) are used to hold a first lower portion 22 to a second lower portion 32. The yoke 40 can be snap-fitted to the first and second upper portions 24, 34 (described in more detail later). A housing for the reducer valve 140 is defined between the first and second parts 20, 30 in order to retain the reducer valve 140 on the back frame 10.

In this embodiment the longitudinal extent along which the first and second parts 20, 30 are attached is a longitudinal axis 12 which is coincident with a longitudinal centre line of the back frame. However, as will be readily apparent to one skilled in the art, the longitudinal extent of attachment may be orientated at 45°, or any other suitable angle, to the longitudinal axis.

Figure 7:
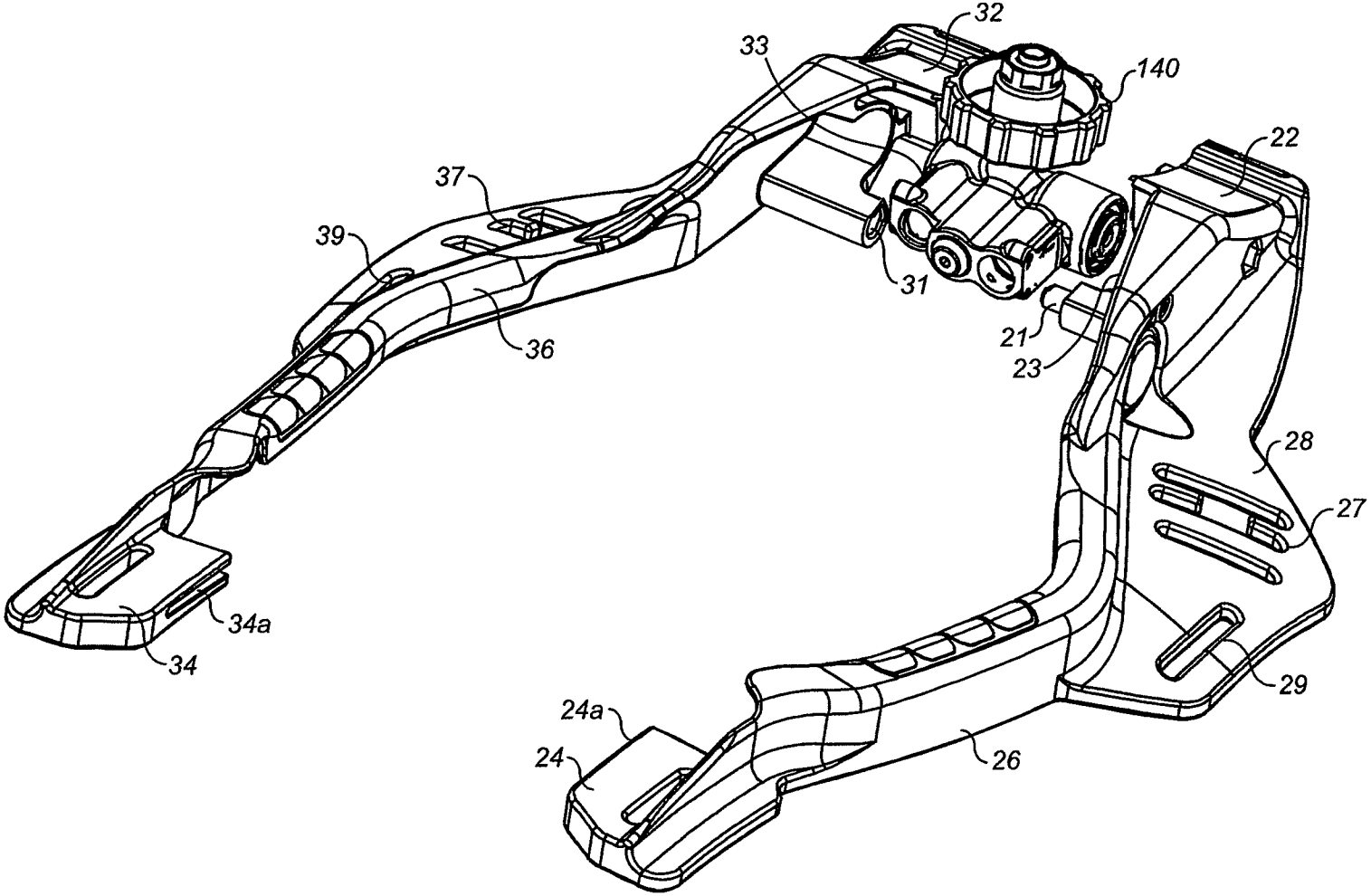
FIG. 7 schematically shows first and second parts of the back frame being assembled around a gas-cylinder reducer valve.

Referring now to FIG. 7, the first lower portion 22 of the first part 20 comprises a first recess 23 and the second lower portion 32 of the second part 30 comprises a second recess 33. During assembly of the harness 100 first and second lower portions 22, 32 are assembled around the reducer 140 such that it is housed within both the first recess 23 and the second recess 33. After the first and second lower portions 22, 32 have been fixed together using a nut and bolt (or other fixing device) the reducer is retained within the lower portion 11 of the back frame 11. The housing defined by the first and second recesses 23, 33 of the first and second parts 20, 30 protect any delicate components of the reducer valve 140 and also reduce the overall profile of the harness 100 because a portion of the reducer 140 is located within the back frame 10. The reducer 140 is also fixed to the back frame 10 without the need for additional fixing components.

Figure 8:
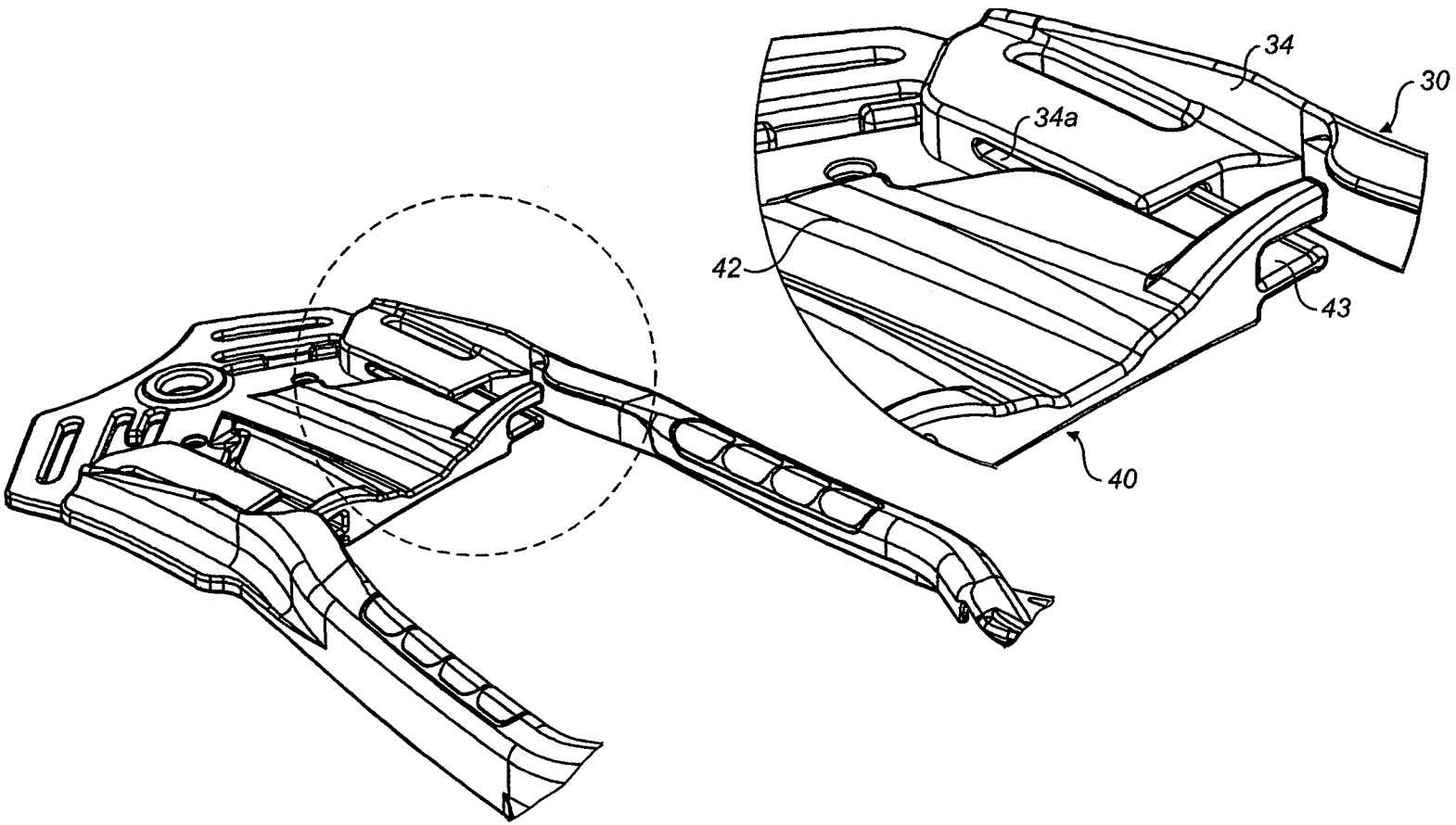
FIG. 8 schematically shows the yoke portion being attached to first and second parts of the back frame.

After the first and second parts 20, 30 have been attached together by the first and second lower portions 22, 32, the yoke 40 is attached between the first and second upper portions 24, 34. As shown in FIG. 8, this is done by slotting the tongues 41, 43 of the first and second attachment portions 42, 44 of the yoke, into first and second grooves 24*a*, 34*a* (FIG. 7) provided in the first and second upper portions 22, 32 of the first and second parts 20, 30. This is a snap-fit-type connection that can be made without the need for tools.

Figure 9:
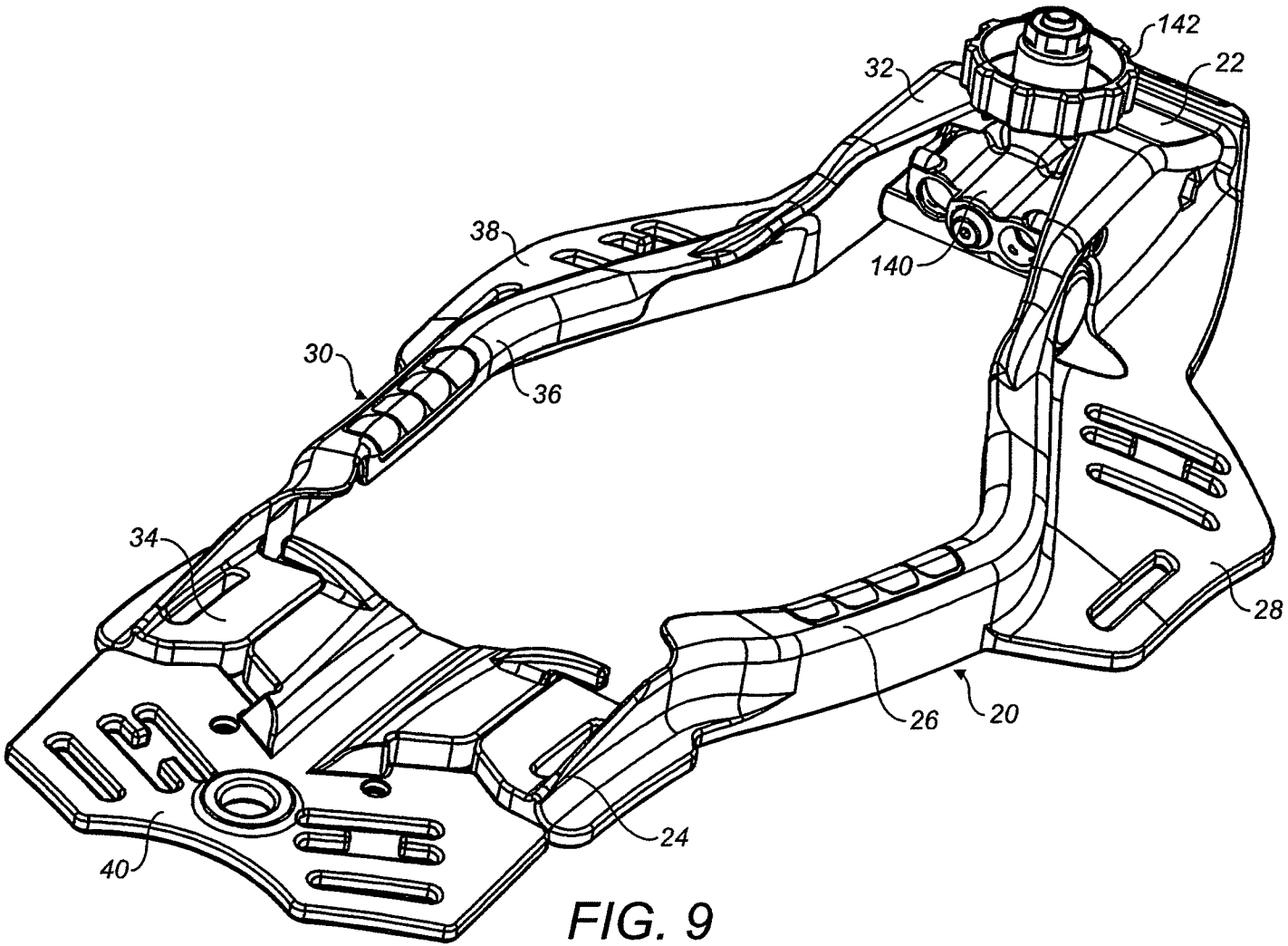
FIG. 9 schematically shows a perspective view of the back frame of FIG. 1.

The assembled back frame 10 having a reducer valve 140 housed within the lower portion 11 can be seen in FIG. 9. The reducer valve 140 comprises a cylinder connection portion 142 that protrudes from the housing such that a gas-cylinder can be attached thereto.

Figure 10:
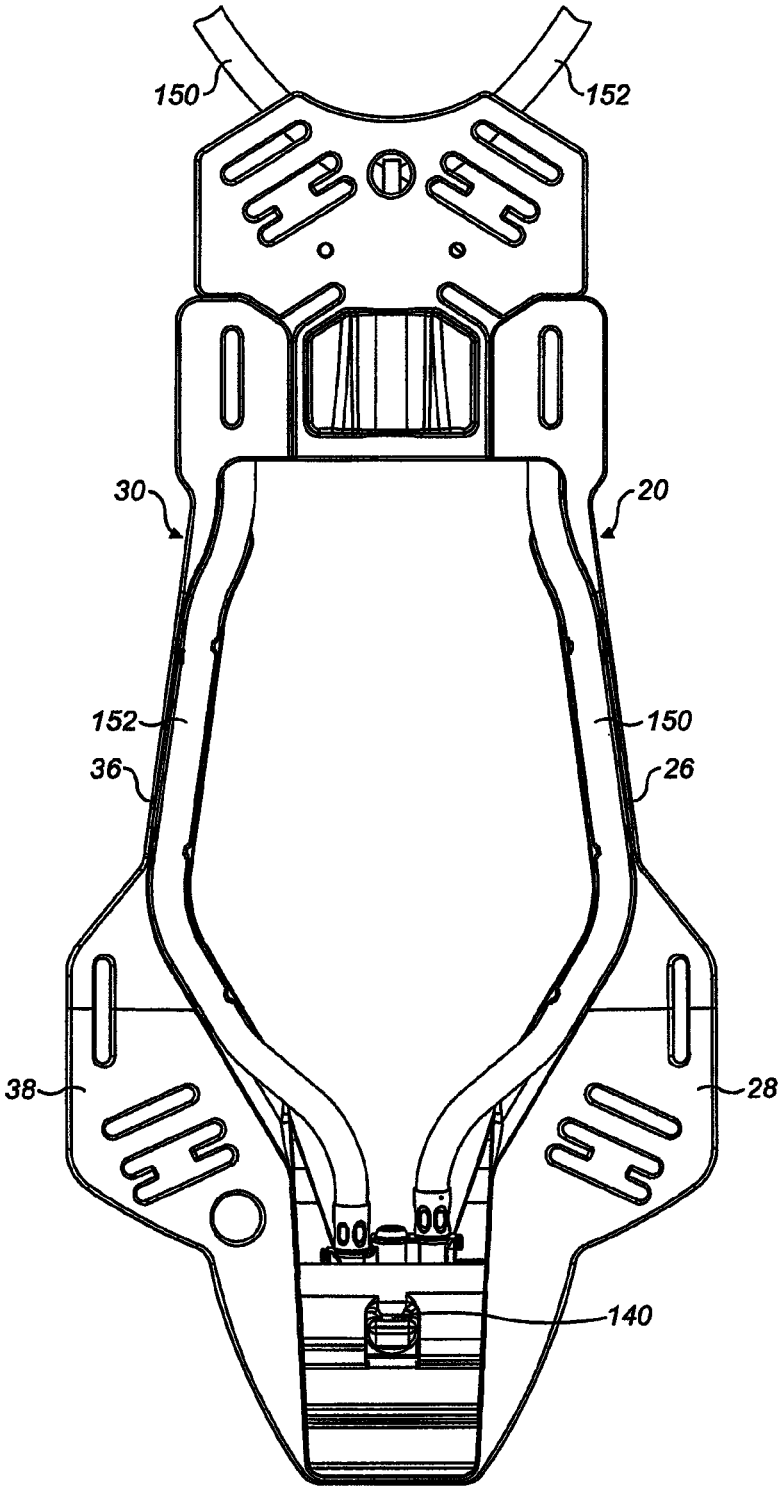
FIG. 10 schematically shows a rear view of the back frame of FIG. 1 with flexible conduits located in guide channels.

With reference to FIG. 10, after the back frame 10 has been assembled, a high-pressure hose 150 and a medium-pressure hose 152 are attached to the reducer valve 140. The high-pressure hose 150 is located in the first guide channel 25 of the first side limb 20 and the medium-pressure hose 152 is located in the second guide channel 35 of the second side limb 30. The hoses 25, 35 cross to the front side of the back frame 10 in the region of the yoke 40, cross over, and are positioned on the shoulder straps 110, 120 (FIG. 1).

Referring back to FIG. 1, assembly of the harness 100 can be completed by attaching the left and right shoulder straps 110, 120, the waist strap 130 and the cylinder retaining strap 136. The harness 100 is particularly light due to the large void 14 that occupies a substantial area of the back frame 10. As can be seen from FIG. 2, the void 14 is substantially longitudinally and transversely coextensive with the gas cylinder 1. The first and second side limbs 26, 36 are spaced either side of the gas-cylinder.

The harness 100 is also comfortable for a wearer. When a user wears the harness 100 on his or her back, the back frame 10 only contacts the user at a lower region and an upper region. When a user bends over his back/spine bends into the void 14. This cannot occur with conventional harnesses 100.

With conventional harnesses a user's back is forced against a back plate when the user bends over, which can be uncomfortable.

Further, because a user's spine/back can be accommodated in the void, the overall profile of the user including the harness is smaller. This makes crawling and climbing through small spaces easier.

Figure 11:
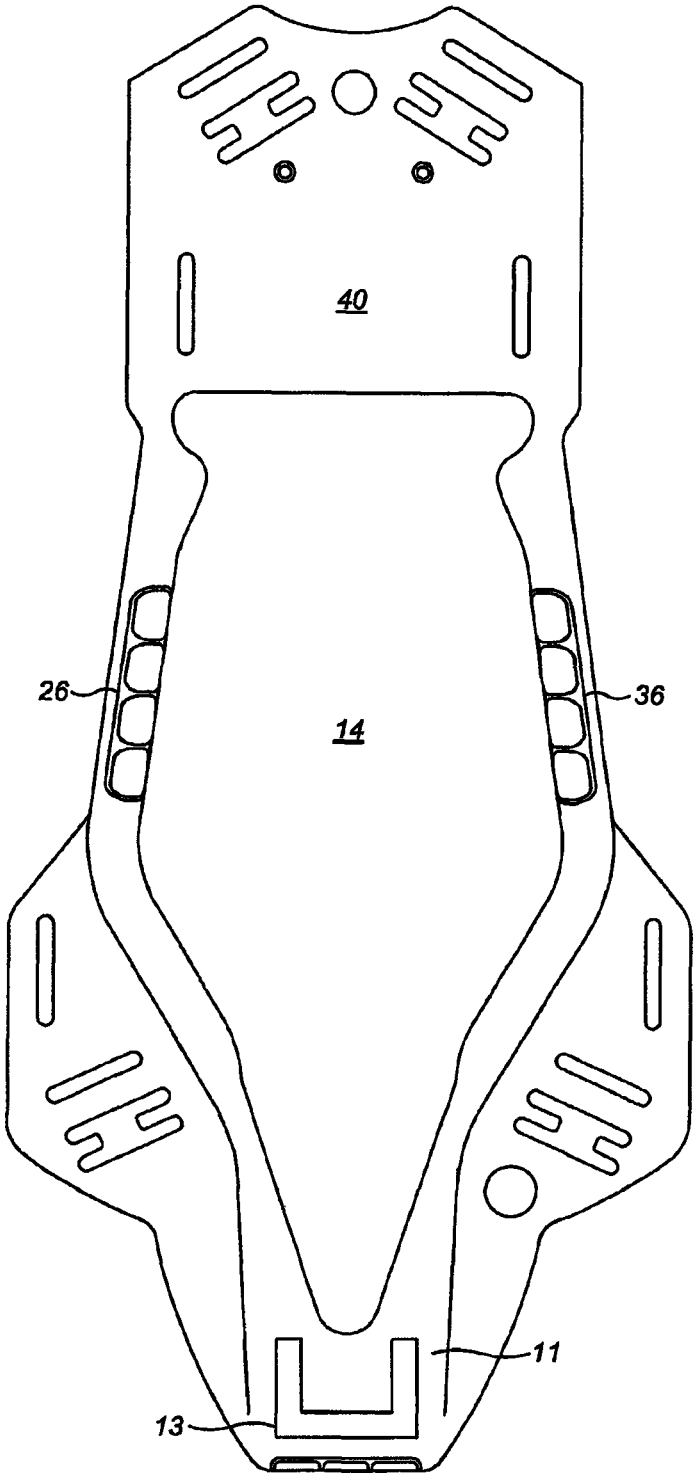
FIG. 11 schematically shows a back frame for a harness for breathing apparatus according to a second embodiment of the present invention.

A further embodiment is shown in FIG. 11. This embodiment is identical to the first embodiment except that the back frame 10 is integrally formed with a lower portion 11, an upper portion 40 and first and second side limbs 26, 36. A reducer valve 140 can be mounted to the front of the lower portion 11 of the back frame 10 using a mounting portion 13. A large void 14 in a central region of the back frame 10 is delimited by the upper portion 40, the lower portion 11 and the first and second side limbs 26, 36.

The invention claimed is:

1. A structural support member for a harness for breathing apparatus, the structural support member being generally elongate and arranged in use to support a cylinder of breathable gas, the structural support member comprising:

a back frame having:

a lower portion arranged in use to support a first end of a cylinder;

an upper portion arranged in use to support a second opposed end of the cylinder; and first and second side limbs coupling the upper and lower portions and defining a void therebetween, in a substantially central region of the back frame;

wherein each of the first and the second side limbs has a guide channel integrally formed within the limb and extending along a substantial longitudinal extent of the limb for accommodating a flexible conduit.

2. A structural support member for a harness for breathing apparatus according to claim 1, wherein the void is substantially longitudinally coextensive with the gas-cylinder that is to be mounted on the back frame.

3. A structural support member for a harness for breathing apparatus according to claim 1, wherein the void is substantially transversely coextensive with the gas-cylinder that is to be mounted on the back frame.

4. A structural support member for a harness for breathing apparatus according to claim 1, wherein the void is arranged such that in use it can accommodate a portion of a wearer's back/spine when the wearer bends his back/spine.

5. A structural support member for a harness for breathing apparatus according to claim 1, wherein the void is delimited by the upper portion, the lower portion and the first and second limbs.

6. A structural support member for a harness for breathing apparatus according to claim 1, wherein the first and second side limbs are spaced either side of the gas-cylinder that is to be mounted to the back frame.

7. A structural support member according to claim 1, wherein the at least one guide channel comprises a plurality of longitudinally spaced retaining means for retaining the flexible conduit.

8. A structural support member for a harness for breathing apparatus according to claim 1, wherein the upper portion comprises a yoke that is detachably attached to the back frame.

9. A structural support member for a harness for breathing apparatus according to claim 8, wherein the yoke is detachably attached to the first and second side limbs.

10. A structural support member for a harness for breathing apparatus according to claim 1, wherein the structural support member is arranged in use to support one or more components operatively associated with the breathing apparatus, and wherein the structural support member comprises first and second parts attached along a longitudinal extent of the structural support member and defining therebetween a housing for retaining one or more of the components.

11. A structural support member for a harness for breathing apparatus according to claim 10, wherein the longitudinal extent along which the first and second parts are attached is substantially coincident with the longitudinal centreline of the structural support member.

12. A structural support member for a harness for breathing apparatus according to claim 10, wherein the first and second parts define a housing within the lower portion of the structural support member arranged in use to retain a valve for the cylinder.

13. A structural support member for a harness for breathing apparatus according to claim 10, wherein the first part comprises the first side limb and the second part comprises the second side limb.

14. A structural support member for a harness for breathing apparatus according to claim 10, wherein the longitudinal extent along which the first and second parts are attached is substantially coincident with a longitudinal centreline of the lower portion.

15. A structural support member for a harness for breathing apparatus, the structural support member being generally elongate and arranged in use to support a cylinder of breathable gas, the structural support member comprising:

a back frame having:

a lower portion arranged in use to support a first end of a cylinder;

an upper portion arranged in use to support a second opposed end of the cylinder; and first and second side limbs coupling the upper and lower portions and defining a void therebetween, in a substantially central region of the back frame;

wherein at least one of the first and second side limbs has a guide channel formed within the limb for accommodating a flexible conduit, the at least one guide channel comprising a plurality of longitudinally spaced retaining means for retaining the flexible conduit.

16. A structural support member according to claim 15, wherein the at least one guide channel is integrally formed within the limb and extends along a substantial longitudinal extent of the limb.

17. A structural support member according to claim 15, wherein each of the first and the second side limbs has a guide channel formed within the limb for accommodating a flexible conduit, the guide channel comprising a plurality of longitudinally spaced retaining means for retaining the flexible conduit.

18. Breathing apparatus equipment, comprising:

a harness including a structural support member;

a reducer valve mounted to the structural support member, to which a cylinder of breathable gas can be attached; and at least first and second flexible conduits extending from the reducer valve;

the structural support member being generally elongate and arranged in use to support a cylinder of breathable gas, the structural support member comprising a back frame having:

a lower portion arranged in use to support a first end of the cylinder;

an upper portion arranged in use to support a second opposed end of the cylinder; and first and second side limbs coupling the upper and lower portions and defining a void therebetween, in a substantially central region of the back frame;

left and right shoulder straps each having an upper end attached to the upper portion of the structural support member and a lower end attached to the lower portion of the structural support member;

wherein the first side limb has a first guide channel integrally formed within the first guide limb and wherein the second side limb has a second guide channel integrally formed within the second guide limb, the first and second guide channels each extending along a substantial longitudinal extent of the respective side limb; and wherein the first flexible conduit is disposed within and along the length of the first guide channel and wherein the second flexible conduit is disposed within and along the length of the second guide channel; and wherein the first flexible conduit exits the first guide channel towards the upper portion of the structural support member and extends to a position on the left shoulder strap and wherein the second flexible conduit exits the second guide channel towards the upper portion of the structural support member and extends to a position on the right shoulder strap.

* * * * *